US006712404B2

(12) United States Patent
Davies et al.

(10) Patent No.: US 6,712,404 B2
(45) Date of Patent: Mar. 30, 2004

(54) SIMPLIFIED INTEGRAL INSIDE AND OUTSIDE HANDLE AND OPERATOR FOR A LATCH MEMBER FOR CLOSURES

(75) Inventors: Sean Davies, Vaughan (CA); Sinnathamby Kupenthirarajan, Vaughan (CA)

(73) Assignee: Preferred Engineering Products Ltd., Vaughan (CA)

( * ) Notice: Subject to any disclaimer, the term of this patent is extended or adjusted under 35 U.S.C. 154(b) by 0 days.

(21) Appl. No.: 09/866,192

(22) Filed: May 29, 2001

(65) Prior Publication Data

US 2002/0180217 A1 Dec. 5, 2002

(51) Int. Cl.[7] ..... E05C 19/06
(52) U.S. Cl. ..... 292/87; 292/DIG. 46
(58) Field of Search ..... 292/DIG. 38, DIG. 30, 292/DIG. 46, DIG. 63, 85, 87, 88; 160/290.1

(56) References Cited

U.S. PATENT DOCUMENTS

| | | | | | |
|---|---|---|---|---|---|
| 4,068,872 | A | * | 1/1978 | Smith | 292/87 |
| 4,106,239 | A | * | 8/1978 | Bancroft | 49/449 |
| 4,284,299 | A | | 8/1981 | Kelly | 292/87 |
| 4,480,676 | A | * | 11/1984 | Solomon | 160/272 |
| 4,480,862 | A | | 11/1984 | Fleming | 292/162 |
| 4,993,762 | A | * | 2/1991 | Rogers | 292/303 |
| 5,702,147 | A | * | 12/1997 | Essig | 296/106 |
| 5,934,353 | A | * | 8/1999 | Buhr | 160/269 |

* cited by examiner

*Primary Examiner*—Gary Estremsky
(74) *Attorney, Agent, or Firm*—Neil H. Hughes; Ivor M. Hughes; Marcelo K. Sarkis

(57) ABSTRACT

A handle for a movable closure, such as a screen having at least one edge frame preferably for retaining a screen cloth, said closure being movable into a slot-like recess disposed in a structure against which the closure engages. The handle comprising a first inside flexible member and a second outside flexible member.

17 Claims, 7 Drawing Sheets

SIMPLIFIED INTEGRAL INSIDE AND OUTSIDE HANDLE AND OPERATOR FOR A LATCH MEMBER FOR CLOSURES

FIELD OF INVENTION

This invention relates to simple handle assemblies for the end of closure members made from flexible resilient material and in a preferred embodiment including two parts, an inside handle member and an outside handle member which when joined together, provide the handle assembly.

BACKGROUND OF THE INVENTION

The provision of the locking member and handle for screen closures particularly those associated with sliding glass doors and windows has presented a challenge to the designers of these types of closures. The screen adjacent to a door or window is often overlooked insofar as the hardware used to open and close the screen. There is typically very little clearance between the screen and the adjacent door so that the handle must be of minimum thickness. It cannot interfere with the movement of the door or window, and has as yet not been effectively produced. It may be secured to the screen frame by punching or notching the frame as is commonly done in the lock mechanisms of sliding doors.

Of additional significance is the fact that the screen door or window constitutes a relatively low priced item and the handle and latch mechanism, although it must meet all of the foregoing requirements, must also be of minimum cost and high degree of reliability.

Within the prior art there exists U.S. Pat. No. 4,284,299 issued in 1981 to Kelly for a simple handle for a sliding screen. There also exists U.S. Pat. No. 4,480,862 to Fleming for a latching and locking mechanism for sliding doors. The present invention much simplifies the structure of Fleming and improves over the structure of Kelly by providing an inside and an outside handle member which interfit and interact to release a latch finger from a compatible latch part.

Nowhere within the prior art is such a simplified improved handle assembly provided which is operable to release the latch from both the inside and the outside.

It is therefore an object of this invention to overcome many of the deficiencies in the prior art stated above which allows for reliable yet simple operation of a handle member which is capable of operating both from the inside and the outside.

It is therefore another object of this invention to overcome many of the deficiencies in the prior art stated above which allows for reliable yet simple operation of a handle assembly for a retractable screen assembly operable from the exterior and the interior.

It is yet a further object of the invention to provide an inexpensive handle assembly for a moveable closure member.

It is a further object of the invention to provide a handle assembly which facilitates ease of manufacture, and replacement.

Further and other objects of this invention will become apparent to a man skilled in the art when considering the following summary of the invention and the more detailed description of the preferred embodiments illustrated herein.

SUMMARY OF THE INVENTION

We have invented a simple, low-cost handle, latch and release mechanism for moveable closures such as sliding windows, screen doors and similar closures such as roll-up screens. The handle mechanism requires providing two holes into the retaining frame for securing screws only to be mounted thereto.

According to a primary aspect of the invention there is provided a handle for a movable closure such as a screen having at least one edge frame preferably for retaining a screen cloth, abutting engagement with the said closure being moveable into engagement with a framing structure therefor;

said handle comprising a first inside flexible member and a second outside flexible member each having a mounting portion for mounting to said at least one edge frame, said mounting portions and preferably said first and second members extending in a direction substantially normal to the direction in which the closure moves, said first inside flexible member and second outside flexible member for inter-fitting with one another to provide said handle, said first inside flexible member including, a first abutting part including a bearing surface for abutment with said second outside flexible member, and a resilient latch finger formed integrally therewith and extending from the plane of the first inside flexible member so as to engage in a latching relationship with a latch portion provided with said structure, said resilient latch finger being deflectable generally towards and away from the plane of the closure to allow it to engage with said latch portion, said second outside flexible member including a second abutting part having a bearing surface (for example a bull-nose end) for abutment with the first bearing surface of said first inside flexible member, wherein when said first inside flexible member is flexed in a first direction the resilient latch finger will be placed in a position to engage/disengage said latch portion, and wherein when said second outside flexible member is flexed in said first direction said second bearing surface of said second abutting part thereof will engage said first bearing surface of said first abutting part of said first inside flexible member thereby causing said first inside flexible member to flex in said first direction placing said the resilient latch finger in a position to engage/disengage said latch portion, thereby providing a simple inside and outside latch release for said closure.

According to a preferred aspect of the invention there is provided a closure assembly comprising a moveable screen accumulating on and paying out from a spring biased roll, the closure assembly having a latch portion on a frame portion thereof for engagement with a screen handle, said screen handle further comprising a first inside flexible member and a second outside flexible member each having a mounting portion for mounting to said at least one edge frame, said mounting portions and preferably said first and second members extending in a direction substantially normal to the direction in which the closure moves, said first inside flexible member and second outside flexible member for inter-fitting with one another to provide said handle, said first inside flexible member including, a first abutting part including a bearing surface for abutment with said second outside flexible member, and a resilient latch finger formed integrally therewith and extending from the plane of the first inside flexible member so as to engage in a latching relationship with a latch portion provided with said structure, said resilient latch finger being deflectable generally towards and away from the plane of the closure to allow it to engage with said latch portion, said second outside flexible member including a second abutting part having a bearing surface (for example a bull-nose end) for abutment with the first bearing surface of said first inside flexible member, wherein when said first inside flexible member is flexed in a first direction the resilient latch finger will be placed in a position to engage/disengage said latch portion, and wherein when said second outside flexible member is flexed in said first direction said second bearing surface of said second abutting part thereof will engage said first bearing surface of said first abutting part of said first inside flexible member thereby causing said first inside flexible member to flex in said first direction placing said the resilient latch finger in a position to engage/disengage said latch portion, thereby providing a simple inside and outside latch release for said closure.

Preferably each of said inside and outside members includes an integral portion defining a hand grip. In a preferred embodiment said mounting portions for each of said inside and outside members includes flanges having integral screw ports which inter-fit to mount to said edge frame. It is preferred that said handle is made from acetal or the like and preferably that a low friction material be used. In another embodiment a gap is provided between said abutting part and said mounting part. Preferably a flexing section is provided between said handle grip and said abutting part for each of said inside and outside members. It is preferred that said abutting part includes a bull-nose end or the like therewith to provide levering action. In one embodiment the first and second flexible members are formed as one part.

It is important that the mounting parts be provided with a flex zone, while the abutting parts remain rigid with the handle portions. This is accomplished by varying the thickness of the material thereat.

BRIEF DESCRIPTION OF THE DRAWING

The following figures illustrate preferred and alternative embodiments of the invention, wherein.

DETAILED DESCRIPTION OF THE INVENTION

Figure 1:
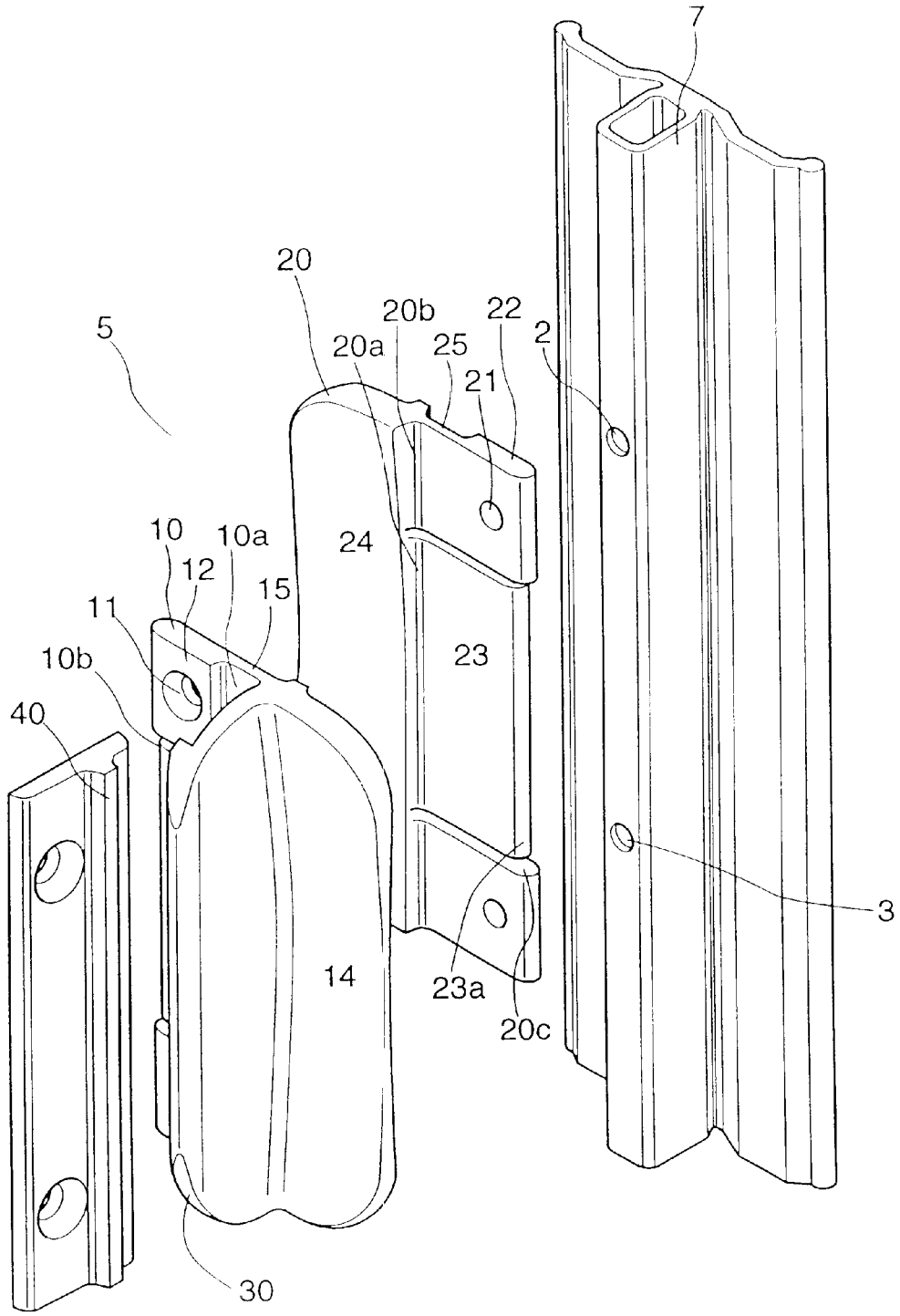
FIG. 1 is an exploded perspective view of the handle assembly illustrated in a preferred embodiment of the invention.
Figure 2:
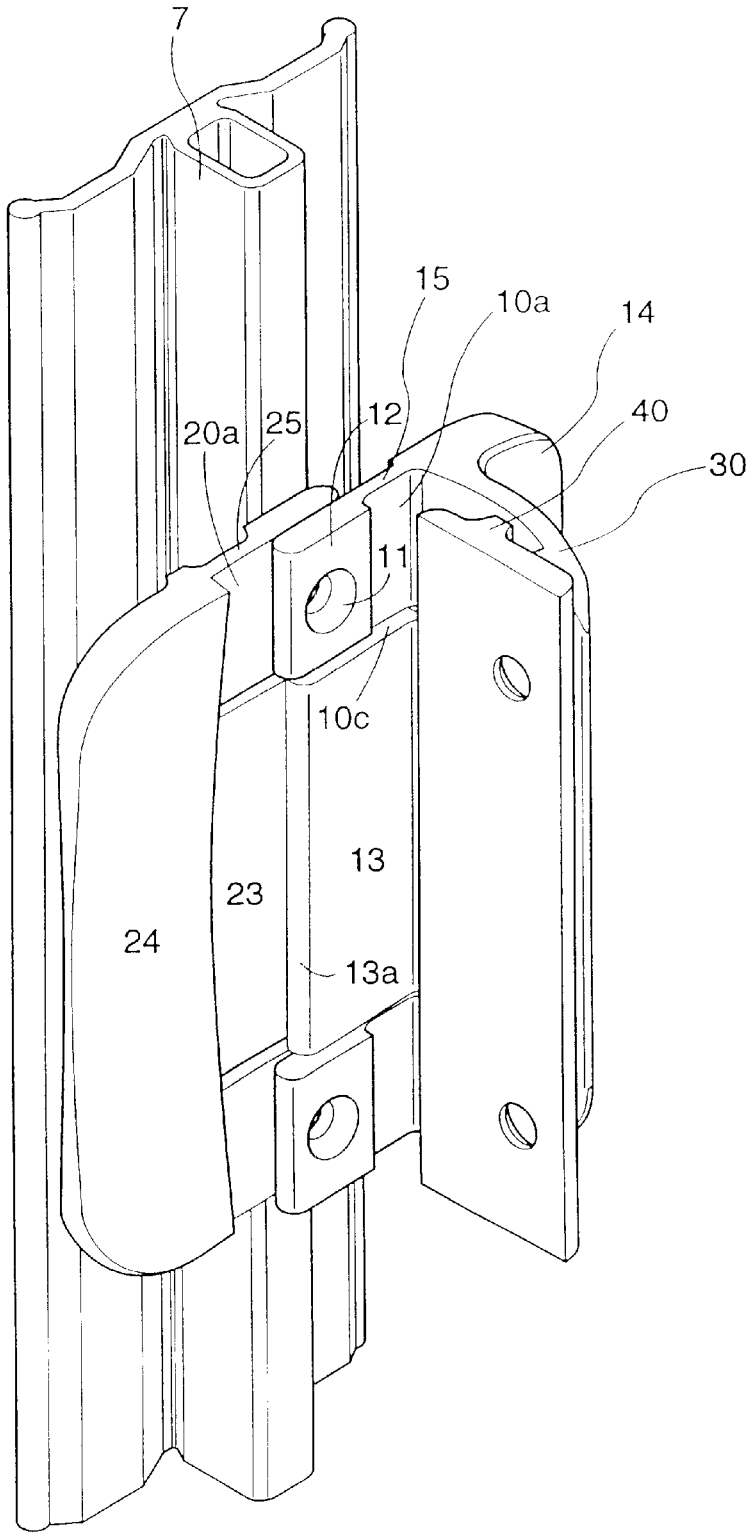
FIG. 2 is a schematic view of the assembly of FIG. 1 as installed on an edge frame portion and illustrated in the preferred embodiment of the invention.
Figure 3:
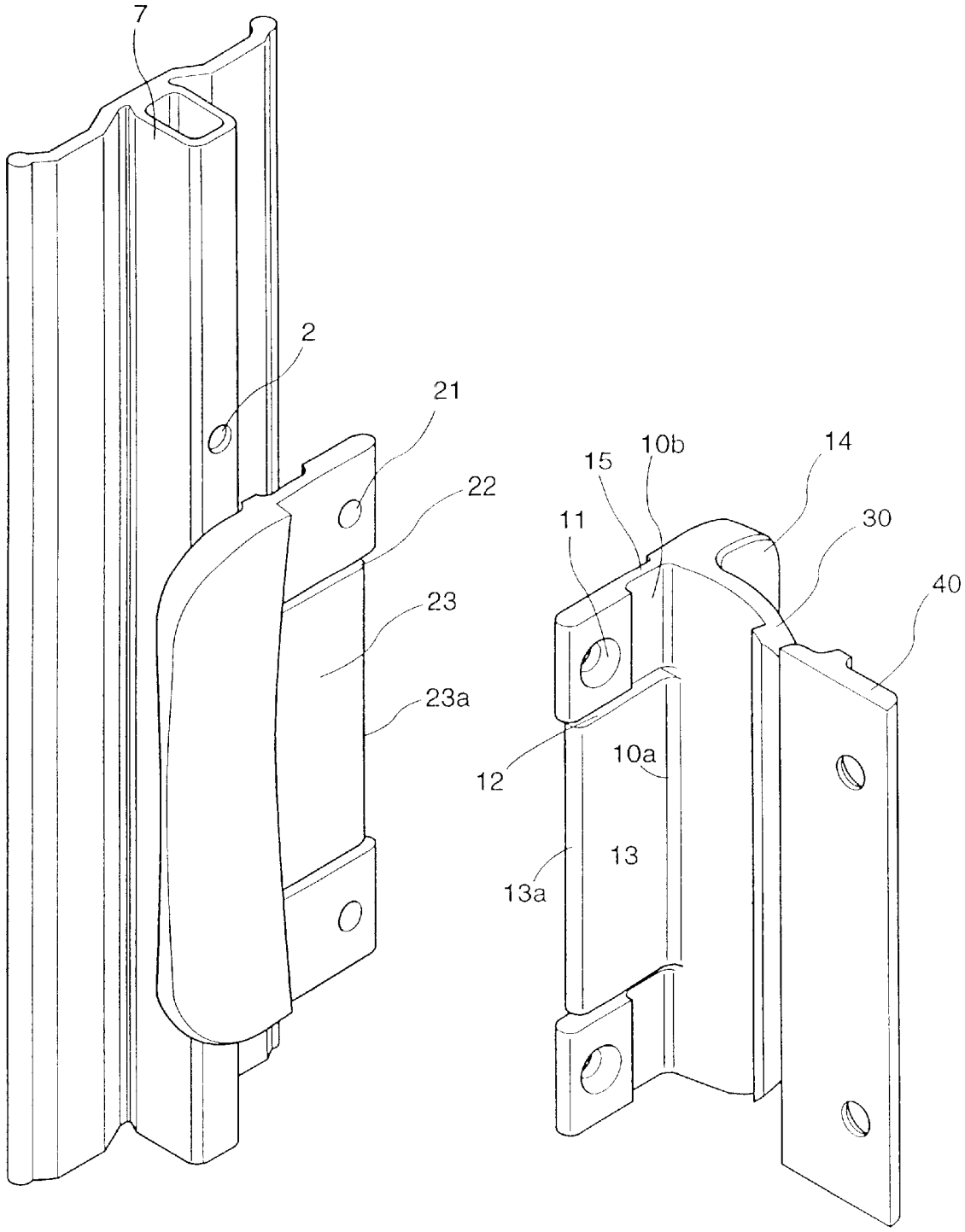
FIG. 3 is a similar view to that of FIG. 1 from the opposite angle.
Figure 4:
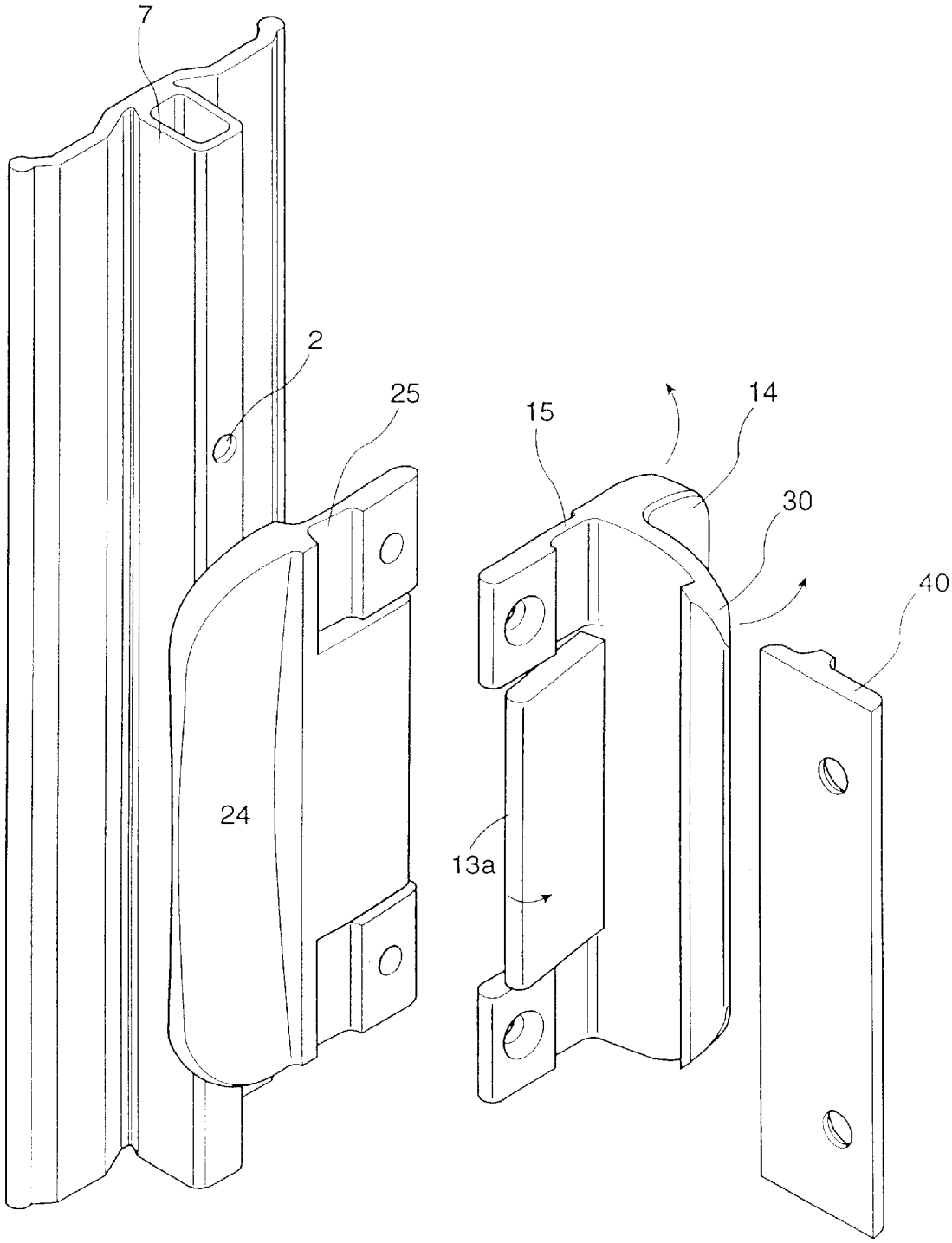
FIG. 4 is a view similar to FIG. 3 showing the operation of the inside handle portion (14) and illustrated in a preferred embodiment of the invention.
Figure 5:
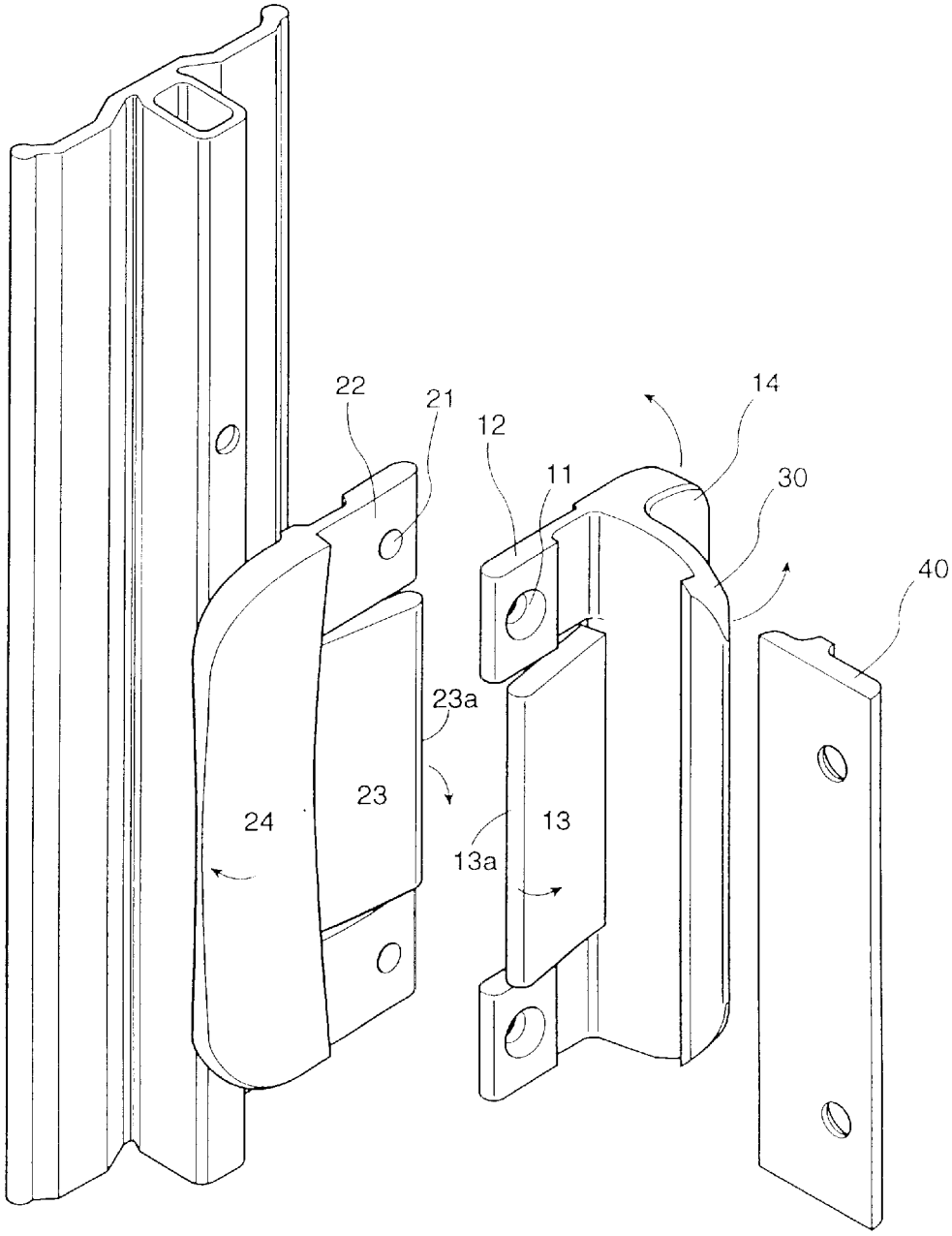
FIG. 5 is a view similar to FIG. 4 illustrating the operation of the outside handle and the interaction of the parts of the handle assembly illustrated in a preferred embodiment of the invention.
Figure 6:
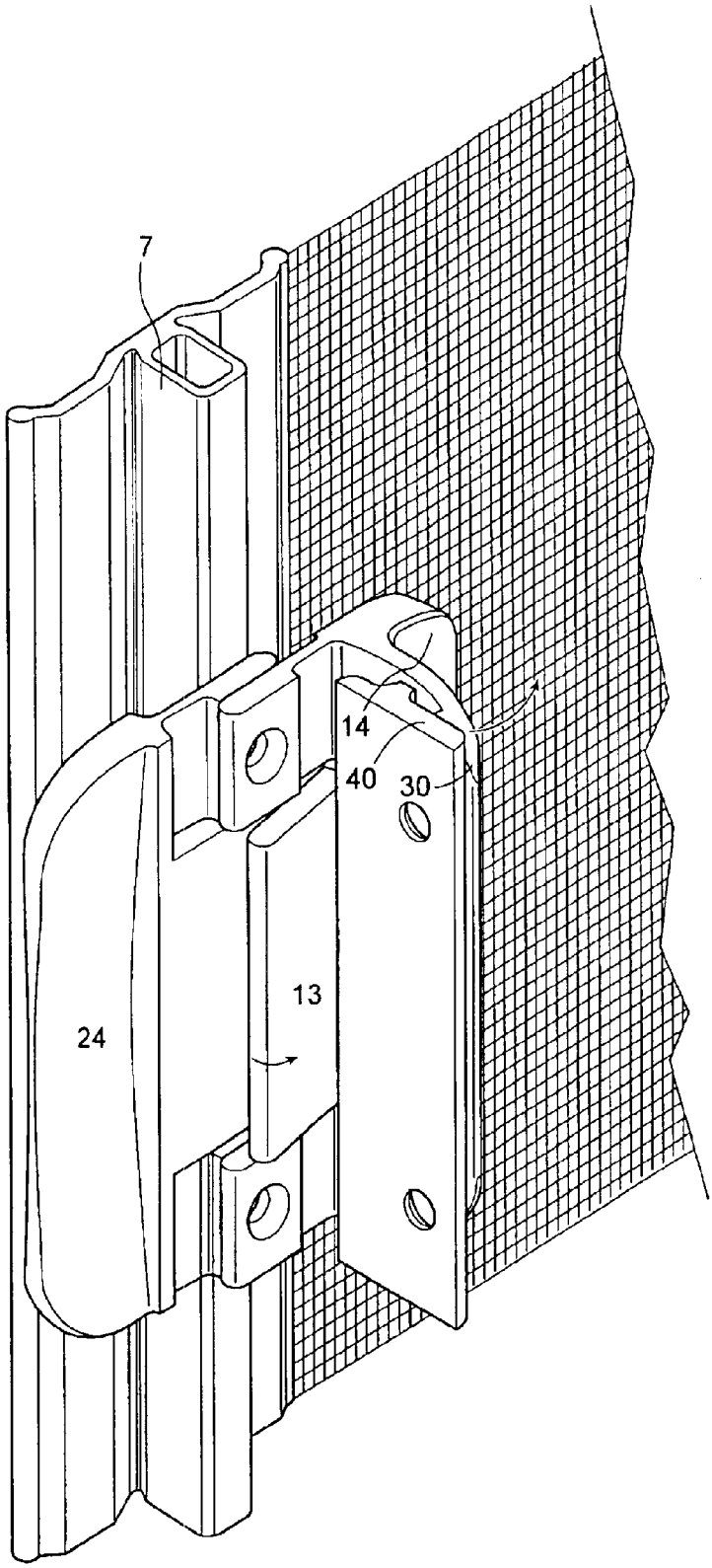
FIG. 6 is an assembled view of FIG. 4.
Figure 7:
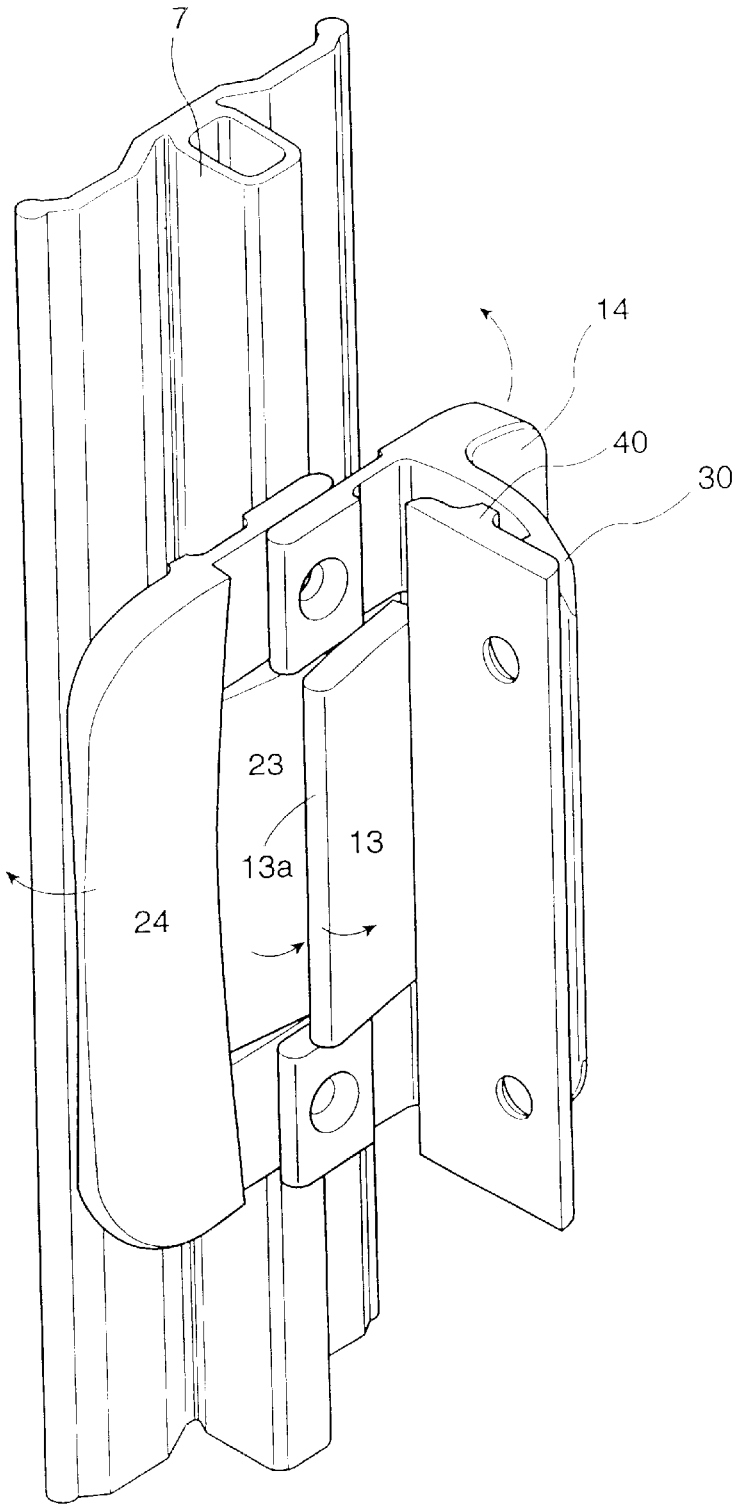
FIG. 7 is an assembled view of FIG. 5.

The present invention provides a simplified structure for which a handle assembly can be manufactured. It is important that the handle assembly be manufactured from a resilient plastic material and preferably acetal having a low coefficient of friction. Other resilient materials may also be appropriate as long as the appropriate amounts of flexing are provided as will be described hereinafter. The handle assembly includes an inside handle member and an outside handle member which when installed on a framing member defining the edge of the screen, for example, a screen door which slides in a track as is well known or alternatively a roll away screen assembly which pays out from and accumulates back onto a spring biased roller. Both of these assemblies are well known and it is not intended that they constitute part of the invention. The handle assembly may also find application with regard to sliding windows which are considered to be analogous in function to the operation for said handle assembly. The handle may also be installed on any other sliding or rolling device which involves latching of the device to a framing structure.

Referring therefore generally to the figures there is provided a handle assembly (5) for mounting to an edge frame (7) which represents the accessible end of a screen door or roll-up screen. The edge frame portion (7) therefore includes openings (2 and 3) for mounting said handle assembly (5) to said edge member (7). It will be noted that the handle assembly (5) includes two members (10 and 20) made from acetal or the like. The two members (10 and 20) may be installed on the edge member (7) into the openings (2 and 3) via screws not shown or appropriate other fasteners through the openings (11 and 21). Openings (11 and 21) extend from flange portions (12 and 22) extending from members (10 and 20). It will be noted that the member (10) constitutes an inside handle member and that the member (20) constitutes an outside handle member. It will also be noted that each of the inside and outside handle members (10 and 20) also include abutting engaging parts (13 and 23) having bull-nose ends 13*a* and 23*a* respectively, the importance of which will be described hereinafter. A handle part which provides a grip portion for the user of the handle (14 and 24) is provided with the inside and outside handle members (10 and 20). When observing the figures, it will be noted that a flexing portion (15 and 25) is provided between the handle portions (14 and 24) and the abutting engaging surfaces (13 and 23). This will allow the handle portions to flex in relation to the mounting openings (11 and 21) when the handle is accessed by a user while the abutting engaging parts do not flex and remain rigid with the handle grip. The handle portions (10 and 20) are manufactured so as to interfit. To do so, undercuts (10A and 20A) are provided to allow the abutting engagement surfaces (13 and 23) to abut when the handle assembly (5) is installed. It is also pointed out that the flanges (12 and 22) are undercut at (10B and 20B) to allow these parts to interfit when installing the screws into said openings. It is important that a gap (10C and 20C) be provided between said flanges (12 and 22) and the abutting surfaces portions (13 and 23). This separation or gap (10C and 20C) will allow movement of the abutting engaging surfaces (13 and 23) when the handle portions (14 and 24) are accessed by a user.

A latching hook (30) is provided with the inside handle member (10) which extends away from the plane of the member (10) and is integrally formed therewith. The hooking portion (30) is for engagement with a compatible latching part (40) installed on a jamb portion constituting the structure supporting the screen and/or window. The latch hooking portion (30) is sufficiently flexible so as to flex when the screen is moved to a closed position so that the hook portion enters the latch part as is known. When a user accesses the handle part (10) via the hand grip part (14) and pulls the hand grip (14) in the direction shown away from the latch part (40), the hook portion (30) will flex and disengage from said latch part (40). This is achieved since the mounting flanges remain in the same plane as they are installed in when the handle portion is flexed provided for by the gaps previously discussed.

When a user grips the outside handle portion (24) the handle portion will be moved in a direction shown away from the latch part (40) wherein the abutting surfaces (13 and 23) engage via a bull-nose (23A) causing the first inside handle portion (10) to move in an operative direction as shown and to release the hook portion (30) from the latch part (40) identically with the method described in relation to accessing the inside handle part (14).

It will be noted that the inside and outside handle portions (10 and 20) are installed in a direction substantially normal to the direction of travel for the screen or window when it slides in it's guide. These guides are not shown. The latch part 40 is mounted to the jamb frame by convenient fasteners not shown, in a conventional manner.

It is apparent from the foregoing description that this invention is relatively simple in design and provides each of the following features:

1. Provides an integral hand grip from both inside and out;
2. Provides an integral latch;
3. It has only a few moving parts operating the latching finger;
4. Eliminates the need to cut into the screen frame portion which would weaken the frame.

As many changes can be made to the invention without departing from the scope of the invention, it is intended that all material contained herein be interpreted as illustrative of the invention and not in a limiting sense.

The embodiments of the invention in which an exclusive property or privilege is claimed are as follows:

1. A handle for a movable closure such as a screen having at least one edge frame, said closure being movable into engagement with a framing structure therefor;

said handle comprising a first inside flexible handle member and a second outside flexible handle member each having a mounting portion for mounting to said at least one edge frame, said mounting portions and said first and second handle members being adapted to extend in a direction substantially normal to the direction in which the closure moves, said first inside flexible handle member and second outside flexible handle member for inter-fitting with one another to provide said handle, said first inside flexible handle member including, a first abutting part including a bearing surface for abutment with said second outside flexible handle member, and a resilient latch finger formed integrally therewith and extending from the plane of the first inside flexible handle member so as to engage in a latching relationship with a latch portion provided with said structure, said resilient latch finger being deflectable generally towards and away from the plane of the closure to allow it to engage with said latch portion, said second outside flexible handle member including a second abutting part having a bearing surface for abutment with the first bearing surface of said first inside flexible handle member, wherein when said first inside flexible handle member is flexed in a first direction the resilient latch finger will be placed in a position to disengage said latch portion, and wherein when said second outside flexible handle member is flexed in said first direction said second bearing surface of said second abutting part thereof will engage said first bearing surface of said first abutting part of said first inside flexible handle member thereby causing said first inside flexible handle member to flex in said first direction placing said resilient latch finger in a position to disengage said latch portion, thereby providing a simple inside and outside latch release for said closure, wherein said mounting portions for each of said inside and outside handle members includes flanges having integral screw ports which inter-fit to mount to said edge frame, and wherein a gap is provided between said abutting part and said mounting part.

2. A closure assembly comprising a moveable screen, the closure assembly having a latch portion on a frame portion thereof for engagement with a screen handle, said screen handle further comprising a first inside flexible handle member and a second outside flexible handle member each having a mounting portion for mounting to said at least one edge frame, said mounting portions and said first and second handle members extending in a direction substantially normal to the direction in which the closure moves, said first inside flexible handle member and second outside flexible handle member for inter-fitting with one another to provide said handle, said first inside handle flexible member including, a first abutting part including a bearing surface for abutment with said second outside flexible handle member, and a resilient latch finger formed integrally therewith and extending from the plane of the first inside flexible handle member so as to engage in a latching relationship with a latch portion provided with said structure, said resilient latch finger being deflectable generally towards and away from the plane of the closure to allow it to engage with said latch portion, said second outside flexible handle member including a second abutting part having a bearing surface for abutment with the first bearing surface of said first inside flexible handle member, wherein when said first inside flexible handle member is flexed in a first direction the resilient latch finger will be placed in a position to disengage said latch portion, and wherein when said second outside flexible handle member is flexed in said first direction said second bearing surface of said second abutting part thereof will engage said first hearing surface of said first abutting part of said first inside flexible handle member thereby causing said first inside flexible handle member to flex in said first direction placing said resilient latch finger in a position to disengage said latch portion, thereby providing a simple inside and outside latch release for said closure.

3. The invention of claim 2 wherein each of said inside and outside handle members includes an integral portion defining a hand grip.

4. The handle of claim 2 wherein said mounting portions for each of said inside and outside handle members includes flanges having integral screw ports which inter-fit to mount to said edge frame.

5. The handle of claim 3 wherein said mounting portions for each of said inside and outside handle members includes flanges having integral screw ports which inter-fit to mount to said edge frame.

6. The invention of claim 1 or 2 wherein said handle is made from acetal having a coefficient of friction sufficiently low so as to ensure smooth operation of the handle.

7. The invention of claim 3 wherein said handle is made from acetal having a coefficient of friction sufficiently low so as to ensure smooth operation of the handle.

8. The handle of claim 5 wherein a gap is provided between said a abutting part and said mounting part.

9. The handle of claim 3 wherein a flexing section is provided between said handle grip and said abutting part for each of said inside and outside handle members.

10. The handle of claim 5 wherein a flexing section is provided between said handle grip and said abutting part for each of said inside and outside handle members.

11. The handle of claim 1 or 2 wherein said abutting part includes a bull-nose end therewith to provide a levering action.

12. The handle of claim 3 wherein said abutting part includes a bull-nose end therewith to provide a levering action.

13. The handle of claim 1 or 2 wherein the first and second flexible handle members are formed as one part.

14. The handle of claim 3 wherein the first and second flexible handle members are formed as one part.

15. The handle of claim 5 wherein the first and second flexible handle members are formed as one part.

16. The handle of claim 9 wherein the first and second flexible handle members are formed as one part.

17. The handle of claim 11 wherein the first and second flexible handle members are formed as one part.

* * * * *